US007171142B2

(12) United States Patent
Kawakami et al.

(10) Patent No.: US 7,171,142 B2
(45) Date of Patent: Jan. 30, 2007

(54) CONDUCTIVE ROLLER, AND PROCESS CARTRIDGE AND ELECTROPHOTOGRAPHIC APPARATUS WHICH HAVE CONDUCTIVE ROLLER

(75) Inventors: Tomoya Kawakami, Ushiku (JP); Hiroshi Abe, Ushiku (JP); Ayumi Okuda, Moriya (JP); Hirobumi Takahashi, Ushiku (JP)

(73) Assignee: Canon Kasei Kabushiki Kaisha, Tsukuba (JP)

( * ) Notice: Subject to any disclaimer, the term of this patent is extended or adjusted under 35 U.S.C. 154(b) by 0 days.

(21) Appl. No.: 11/338,795

(22) Filed: Jan. 25, 2006

(65) Prior Publication Data

US 2006/0165439 A1 Jul. 27, 2006

(30) Foreign Application Priority Data

Jan. 27, 2005 (JP) ..... 2005-020112

(51) Int. Cl.
*G03G 15/02* (2006.01)

(52) U.S. Cl. ..... 399/176; 399/159; 428/323

(58) Field of Classification Search ..... 399/176
See application file for complete search history.

(56) References Cited

U.S. PATENT DOCUMENTS 6,254,976 B1 * 7/2001 Ono ..... 428/304.4
6,908,419 B2 * 6/2005 Takashima et al. ..... 492/56
6,962,746 B2 * 11/2005 Taniguchi et al. ..... 428/323

* cited by examiner

*Primary Examiner*—David M. Gray
*Assistant Examiner*—Bryan Ready
(74) *Attorney, Agent, or Firm*—Fitzpatrick, Cella, Harper & Scinto

(57) ABSTRACT

In a conductive roller having a conductive substrate, a conductive elastic layer and a conductive cover layer, the conductive cover layer is formed of a seamless tube containing a thermoplastic polymer, the surface of the conductive roller is coated with an inorganic compound the particle surfaces of which have been subjected to hydrophobic treatment, and the roller having been coated therewith has a glossiness of from 7.5% or more to less than 22.0%. This conductive roller can make toner and external additives less adhere to the roller surface, can prevent the faulty images due to the adhesion of photosensitive-member abrasion dust and can well perform charging in the image reproduction from the initial stage to the last.

5 Claims, 2 Drawing Sheets

CONDUCTIVE ROLLER, AND PROCESS CARTRIDGE AND ELECTROPHOTOGRAPHIC APPARATUS WHICH HAVE CONDUCTIVE ROLLER

BACKGROUND OF THE INVENTION

1. Field of the Invention

This invention relates to a conductive roller, and a process cartridge and an electrophotographic apparatus which have the conductive roller.

2. Related Background Art

A number of methods are conventionally known as methods for electrophotography. Copies are commonly obtained by forming an electrostatic latent image on an electrophotographic photosensitive member by utilizing a photoconductive material and by various means, subsequently developing the latent image by the use of a toner to form a visible image as a toner image, transferring the toner image to a transfer medium such as paper, and thereafter fixing the toner image to the transfer medium by heat and/or pressure. Also, toner particles not transferred to the transfer medium and remaining on the photosensitive member are removed through a cleaning step from the surface of the photosensitive member.

As charging assemblies for electrophotography, corona charging assemblies have conventionally been used. In recent years, contact charging assemblies have been put into practical use in place of the former. This aims at low ozone and low power consumption. In particular, a roller charging system making use of a conductive roller as a charging member is preferably used in view of the stability of charging.

In the roller charging, a conductive elastic roller is brought into pressure contact with a member to be charged (charging object) and a voltage is applied thereto to charge the charging object electrostatically. Stated specifically, the charging is performed by causing electric discharge from the charging member to the charging object, and hence the charging takes place upon application of a voltage above a certain threshold voltage. For example, where a charging roller is brought into pressure contact with an organic electrophotographic photosensitive member having a thickness of 25 μm (an OPC electrophotographic photosensitive member), the surface potential of the electrophotographic photosensitive member begins to rise upon application of a voltage of about 640 V or above and, at voltages above that voltage, the electrophotographic photosensitive member surface potential increases linearly at a gradient 1 with respect to the applied voltage. This threshold voltage is hereinafter defined as charging start voltage Vth.

That is, in order to attain an electrophotographic photosensitive member surface potential Vd considered necessary for electrophotography, a DC voltage of Vd+Vth that is higher than is necessary must be applied to the charging roller. Such a method of applying only DC voltage to the contact charging member to perform the charging in this way is called DC charging.

In DC charging, however, it has been difficult to control the potential of the electrophotographic photosensitive member to the desired value, because any environmental variations may cause variations in electrical resistance of the contact charging member and also because any changes in layer thickness due to abrasion of the electrophotographic photosensitive member surface may cause variations in the Vth.

Accordingly, in order to achieve more uniform charging, an AC charging system is used in which a voltage formed by superimposing an AC component with a 2×Vth or higher peak-to-peak voltage, on a DC component corresponding to the desired Vd is applied to the contact charging member. This is a system aiming at a potential-leveling effect which is attributable to AC, where the potential of the charging object converges to the Vd, the middle of the peak of AC voltage, and may hardly be affected by external disturbance such as environmental variations. In recent years, such contact charging in which the roller-shaped contact charging member is brought into contact with an image bearing member (photosensitive member) to charge the surface of the image bearing member electrostatically is in wide use. The contact charging member has advantages such that it has simple structure and ozone is generated only in a very small quantity.

An example is shown in which a conductive base layer is covered thereon with a conductive seamless tube to form a surface layer, and a multi-layer tube is disclosed which is formed of layers having different conductivities. As a method for manufacturing such a charging member, a method is available in which in the above conventional techniques the surface layer is formed by insertion (see, e.g., Japanese Patent Application Laid-open No. H05-096648).

However, a charging roller obtained by such a method makes use of a thermoplastic resin in the surface layer, and hence, because of a low cross-link density of the resin, any of toner, external additives and photosensitive-member abrasion dust may adhere to the roller surface during the image formation to cause faulty images in some cases.

As a means for solving this problem, a method is commonly proposed in which surface roughness (Rz: ten-point average roughness) is made low to smooth the surface (see, e.g., Japanese Patent Application Laid-open No. 2000-137369). However, where a seamless tube formed basically of a thermoplastic elastomer is produced by the method disclosed in Japanese Patent Application Laid-open No. 2000-137369, the tube is soft because of its own properties, and hence it has not been able to be said that the faulty images due to the adhesion of photosensitive-member abrasion dust can sufficiently be remedied only by lowering surface roughness (Rzjis: ten-point average roughness) to make the surface smooth.

As another means for preventing the toner and external additives from adhering to the roller surface, a method is proposed in which a sponge, a brush or a blade is pressed against the charging roller at a suitable pressing force to clean the charging roller, retaining the charging capability thereof (see, e.g., Japanese Patent Application Laid-open No. H06-149020).

With such construction, however, in the case of the blade, a container used exclusively for holding therein the toner removed is required, and this makes it difficult to make the apparatus compact. In the case of the sponge or brush, cleaning ability lowers when the quantity of toner closed in pores or brush hair comes more than a stated quantity, resulting in a low adhesion preventive effect. There have been such problems.

Accordingly, a method is proposed in which a roller is coated on its surface with an inorganic compound of various types to improve the surface properties of the roller so that the toner and external additive can be made to less adhere to the surface (see, e.g., Japanese Patent Application Laid-open No. 2002-031958).

SUMMARY OF THE INVENTION

However, the effect of lessening adhesion may greatly change depending on the state of coating on the roller. This effect is low if the coating is merely carried out by spraying. It is important to rub powder over the roller surface, and, such a roller can uniformly be coated with an inorganic compound the particle surfaces of which have been subjected to hydrophobic treatment. Because of such uniform coating, the effect of lessening adhesion may greatly be brought out. Also, even a surface on which no difference appears in visual observation or in surface roughness, the state of coating may stand different to bring about a great difference in the effect of lessening adhesion. Hence, the state of coating is judged by glossiness.

Accordingly, the present invention relates to a conductive roller, and an object of the invention is to provide a conductive roller in which an inorganic compound the particle surfaces of which have been subjected to hydrophobic treatment is used as a coating powder and this powder is rubbed over the roller surface to make toner and external additives less adhere to the roller surface and further which can prevent the faulty images due to the adhesion of photosensitive-member abrasion dust and can well perform the charging in the image reproduction from the initial stage to the last, and also to provide a process cartridge and an electrophotographic apparatus which make use of this conductive roller.

That is, the present invention provides a conductive roller which has at least a conductive substrate, a conductive elastic layer and a conductive cover layer, wherein the conductive cover layer is formed of a seamless tube containing a thermoplastic polymer, the surface of the conductive roller is coated with an inorganic compound the particle surfaces of which have been subjected to hydrophobic treatment, and the roller having been coated therewith has a glossiness of from 7.5% or more to less than 22.0%.

The present invention also provides the above conductive roller, wherein the particle surface hydrophobic treatment of the inorganic compound has been carried out using a fatty acid, a coupling agent, an ester or an oil such as silicone oil.

The present invention further provides the above conductive roller, wherein the particle surface hydrophobic treatment of the inorganic compound has been carried out using any of stearic acid, oleic acid and palmitic acid, or using a metal salt of stearic acid, oleic acid or palmitic acid.

The present invention further provides a process cartridge which integrally supports an electrophotographic photosensitive member and a charging member, or an electrophotographic photosensitive member, a charging member and either or both of a developing means and a cleaning means, and is detachably mountable to the main body of an electrophotographic apparatus, wherein the charging member is a charging member provided in contact with the electrophotographic photosensitive member and capable of charging the electrophotographic photosensitive member upon application of a voltage, and makes use of the conductive roller described above.

The present invention further provides an electrophotographic apparatus which has an electrophotographic photosensitive member, a charging member, an exposure means, a developing means and a transfer means, wherein the charging member is a charging member provided in contact with the electrophotographic photosensitive member and capable of charging the electrophotographic photosensitive member upon application of a voltage, and makes use of the conductive roller described above.

In virtue of the foregoing, the conductive roller can be provided which makes toner and external additives less adhere to the roller surface, can prevent the faulty images due to the adhesion of photosensitive-member abrasion dust and can well perform the charging in the image reproduction from the initial stage to the last.

BRIEF. DESCRIPTION OF THE DRAWINGS

DESCRIPTION OF THE PREFERRED EMBODIMENTS

Figure 1:
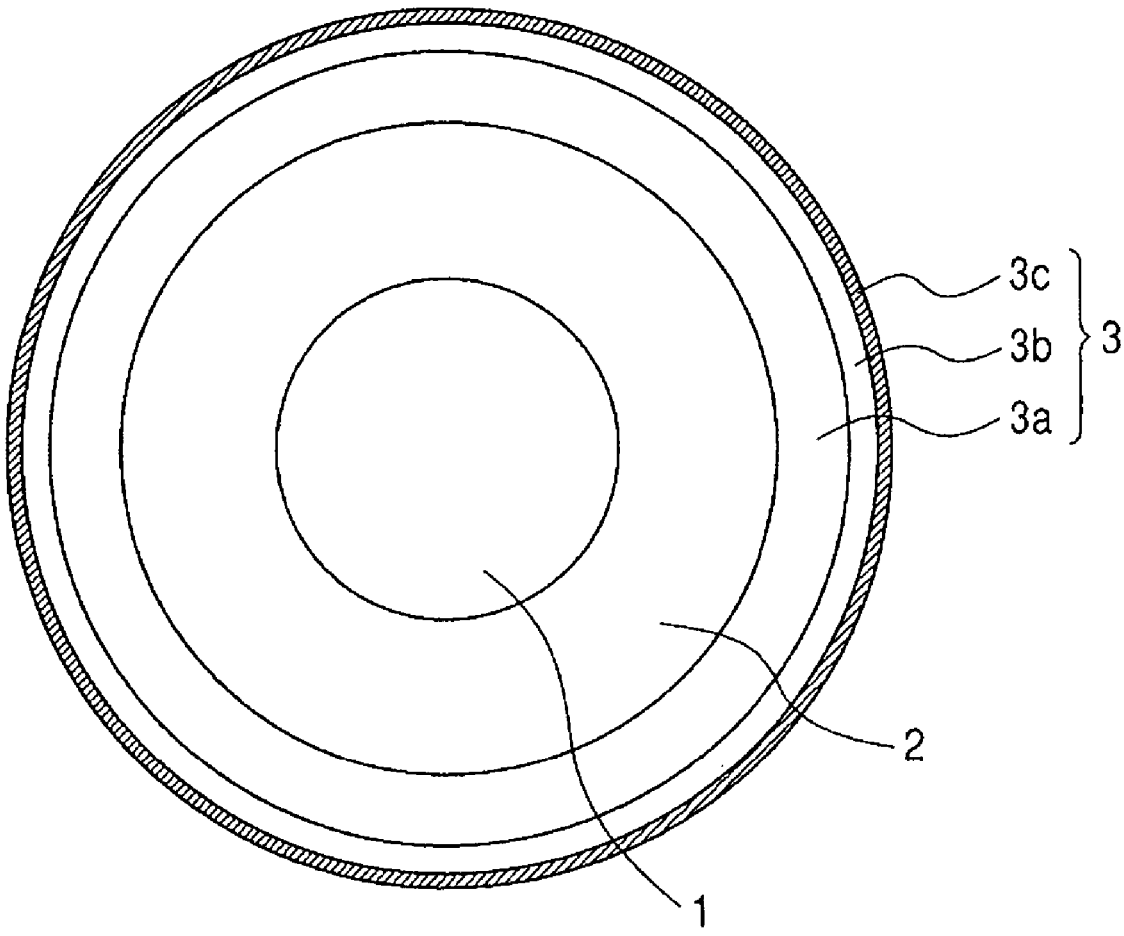
FIG. 1 illustrates the construction of a conductive roller having been coated in the present invention.

As summarized above, the present invention is a conductive roller which has at least a conductive substrate, a conductive elastic layer and a conductive cover layer, wherein the conductive cover layer is formed of a seamless tube containing a thermoplastic polymer, the surface of the conductive roller is coated with an inorganic compound the particle surfaces of which have been subjected to hydrophobic treatment, and the roller having been coated therewith has a glossiness of from 7.5% or more to less than 22.0%.

In the present invention, the surface of the conductive roller is coated with an inorganic compound the particle surfaces of which have been subjected to hydrophobic treatment. The effect intended in the present invention can not be achieved only by its coating. Hence, it is particularly important that the roller having been coated has a glossiness of from 7.5% or more to less than 22.0%.

There are no particular limitations on the conductive substrate and the conductive elastic layer which are used in the present invention. Any known ones may be used.

There are no particular limitations also on the conductive cover layer. Here is used a seamless tube containing a thermoplastic polymer so that a powder of various types can uniformly and strongly be fixed thereto.

As the thermoplastic polymer, any thermoplastic polymer may be used as long as it can be extruded. Stated specifically, preferred are various resins and copolymers including, for example, styrene-butadiene-styrene (SBS) and styrene-butadiene-styrene hydrogenated products (SEBS), polyethylene, polypropylene; saturated polyesters such as polyethylene terephthalate (PET) and polybutylene terephthalate (PBT); polyethers, polyamides, polycarbonate, polyacetals, acrylonitrile-butadiene-styrene, polystyrene, high-impact polystyrene (HIPS), polyurethanes, polyphenylene oxide, polyvinyl acetate, polyvinylidene fluoride and polytetrafluoroethylene; styrene type resins and acrylic resins such as acrylonitrile-butadiene-styrene resin (ABS), acrylonitrile-ethylene/propylene rubber-styrene resin (AES) and acrylonitrile-acrylic rubber-styrene resin (AAS); and vinyl chloride resin and vinylidene chloride resin. Of these, thermoplastic elastomers are particularly preferred, as exemplified by SBS and SEBS.

A conductive roller the surface of which is to be coated with the surface hydrophobic-treated inorganic compound may be obtained in the following way. First, the thermoplastic polymer, and a conductive pigment such as carbon black are kneaded together with necessary additives. Subsequently, the kneaded product obtained is pelletized. Next, the pellets obtained are made into a seamless tube by means of an extruder. Then, the seamless tube, having been worked by forming, is put over the conductive elastic layer provided on the conductive substrate, to cover it as the conductive cover layer. Thus, the conductive roller is obtained.

The conductive roller (before coating) comprising a support member (the conductive substrate having thereon the conductive elastic layer) covered thereon with the seamless tube may preferably have a diameter of 25 mm or less, because a roller having a diameter of more than 25 mm may make the tube distorted in shape to cause faulty charging.

Next, the surface of this conductive roller is coated with the inorganic compound the particle surfaces of which have been subjected to hydrophobic treatment (surface hydrophobic-treated inorganic compound). This inorganic compound is used as a powder, and the surface of this conductive roller (the surface of the seamless tube) is coated with the powder.

As the powder with which the roller surface is to be coated, it may include various inorganic compounds, organic compounds and fine fluorine particles. Preferred is the inorganic compound the particle surfaces of which have been subjected to hydrophobic treatment.

As the inorganic compound to be subjected to surface hydrophobic treatment in the present invention, fine particles may be used which are several nm to tens of nm in particle diameter, as exemplified by DHT-4A (trade name; available from Kyowa Chemical Industry Co., Ltd.; a hydrotalcite compound).

The surface hydrophobic treatment may be carried out using as a hydrophobic-treating agent any of various coupling agents such as a silane coupling agent, a titanate coupling agent and an aluminate coupling agent, esters such as a phthalate and a silicate, oils such as silicone oil, and fatty acids. In particular, higher fatty acids are preferred. Stated specifically, stearic acid, oleic acid, lauric acid and metal salts of these acids are more preferred. As an effect thereof, since the surface portion to be coated contains the thermoplastic polymer, the surface-treated inorganic compound is improved in adherence to the thermoplastic polymer. This enables achievement of coating without non-uniformity and also brings a great effect of lessening the adhesion of toner and external additives to the roller surface.

The hydrophobic treatment of the inorganic compound may be carried out by bringing the inorganic compound into contact with a solution of the hydrophobic-treating agent used in the hydrophobic treatment, followed by drying.

The hydrophobic-treating agent in the above solution used when the inorganic compound is subjected to hydrophobic treatment may be in a concentration ranging from 1% or more to less than 50%. In this range, the adherence between the inorganic compound and the thermoplastic polymer is more improved, and hence one having been treated in this range of concentration may be used.

As methods for coating, methods may be selected in variety. What is effective is a method in which the powder is adsorbed on an adhesive roller and the conductive roller to be coated is brought into direct contact with this adhesive roller, where the adhesive roller is rotated to coat the conductive roller with the powder uniformly.

In order to more strongly rub the powder over, and fix it to, the surface of the conductive roller to be coated, the powder may be rubbed over this roller surface by a dry process.

As a member with which the powder is rubbed over the roller surface, a member constituted of polyester fiber of 5 μm or less in fiber diameter may be used. The use of fiber of more than 5 μm in fiber diameter is not preferable because the roller surface may be scratched without regard to the pressing force applied when rubbed.

Such an inorganic powder (inorganic compound) with which the surface of the conductive cover layer has been coated as described above comes gradually to come off as the conductive roller is used, and hence it follows that the effect attributable to the inorganic powder, of preventing the adhesion of toner becomes lost. However, fine-particle components such as a charge control agent added externally to toner particles show a tendency of more readily adhering to the conductive roller than the toner, and hence, as the conductive roller is used, the fine-particle components adhere to the surface of the conductive roller to come to substitute the inorganic powder with which the surface of the conductive cover layer has been coated. Accordingly, the conductive cover layer may be coated with the inorganic powder at the initial stage where the conductive roller is used, whereby the toner can be prevented from adhering to the conductive roller throughout long-term use.

The glossiness of the conductive roller surface to which the inorganic compound has been fixed by coating is measured with Model VG2000, manufactured by Nippon Denshoku Industries Co., Ltd. To make measurement, both ends of a mandrel of a 12 mm diameter conductive roller having been coated are so fastened that the roller is positioned at the middle of the position of measurement and also does not come shifted during the measurement. There is a possibility that the outside light enters from the position of measurement, and hence the light coming from other places is intercepted with a dark curtain during the measurement, setting the angle of incidence at 75 degrees.

At the time the powder has been fixed to the roller surface, the glossiness must be 7.5% or more to less than 22.0%. If the glossiness is less than 7.5%, the powder does not stand completely fixed on the surface of the conductive roller, and the modification of surface properties is insufficient to lessen the effect of preventing the adhesion of toner and external additives or photosensitive-member abrasion dust. If on the other hand the glossiness is more than 22.0%, powder particles stand so crushed as to lessen the effect of preventing the adhesion. Thus, its upper limit is less than 22.0%

This measurement enables judgement on whether or not the effect intended in the present invention can be reproduced, and it is greatly significant.

EXAMPLES

The present invention is described below by giving Examples. The present invention is by no means limited to these Examples. In the following, "part(s)" refers to "part(s) by mass".

Formation of Cover Tube for Conductive Roller:

As materials for the outer layer of a cover tube (seamless tube), to 60 parts of SEBC type styrene type thermoplastic polymer [styrene content: 20%; melting point: 100° C.; MFR (melt flow rate): 5.6 g/10 minutes (230° C., 2.16 kg); trade name: DYNALON, available from JSR Corporation], 40 parts of an acrylonitrile-styrene copolymer resin (trade name: SANREX, available from Technopolymer Co., Ltd.), 50 parts of acidic carbon black (trade name: SB550, available from Degussa Corp.), 10 parts of magnesium oxide (trade name: STARMAG, available from Konoshima Chemical Co., Ltd.) and 1 part of calcium stearate were added, and these were kneaded at 180° C. for 30 minutes by means of a pressure kneader. The kneaded product obtained was cooled and then pulverized by using a grinding machine, and thereafter the pulverized product was pelletized by means of a single-screw extruder.

As materials for the tube inner layer, to 100 parts of thermoplastic polyurethane elastomer (TPU) (trade name: KURAMILON, available from Kuraray Co., Ltd.), 16 parts of carbon black, 20 parts of conductive titanium oxide (trade name: ET-500W, available from Ishihara Sangyo Kaisha, Ltd.), 10 parts of magnesium oxide (trade name: STAR-MAG, available from Konoshima Chemical Co., Ltd.) and 1 part of calcium stearate were added, and these were kneaded at 180° C. for 15 minutes by means of a pressure kneader, followed by pelletization through the same steps as the materials for outer layer.

The above pellets for the respective layers were extruded by means of a two-color extruder having a die of 18.0 mm in inner diameter and a point of 16.5 mm in outer diameter, followed by sizing and cooling, through the steps of which the extruded products were forming-worked into a seamless tube having an inner diameter of 11.1 mm, a surface-layer (outer-layer) thickness of 100 μm and an inner-layer thickness of 400 μm.

Mandrel:

As a mandrel (conductive substrate), an iron material was formed into a rod material of about 5 mm in diameter by extrusion, and this was cut in 242 mm in length, which was then chemically plated in a thickness of about 3 μm, to ready the mandrel.

Formation of Foamed Elastic Layer:

A mixture prepared by compounding ethylene-propylene-diene type rubber (EPDM) with carbon black, a paraffin type plasticizer, a vulcanizer and a blowing agent was formed into a hose by an extruder to form a hose-shaped foamed elastic layer of 4.5 mm in inner diameter and 11.3 mm in outer diameter as the conductive elastic layer. The above mandrel was inserted to the center hole of this elastic body.

The seamless tube previously obtained was put over the foamed elastic layer to cover it to produce a conductive roller of 12.2 mm in diameter.

Example 1

Hydrotalcite DHT-4A (trade name; available from Kyowa Chemical Industry Co., Ltd.) subjected to surface hydrophobic treatment with stearic acid by 3% was used as the coating powder, and the conductive roller produced as above was coated with this powder by means of an adhesive roller.

Further, while this conductive roller thus coated was rotated at 700 rpm, a sponge roller wound thereon with a powder rub-over member (thin cloth made of polyester fiber of 2 μm in fiber diameter, available from Toray Industries, Inc.) was so pressed against the roller surface that a load of 0.06 kg/cm$^2$ was applied thereto, and the powder rub-over member was reciprocatingly moved in the roller lengthwise direction at a rate of 600 mm/sec for 16 seconds. Thus, a roller as shown in FIG. 1 was obtained to the whole roller surface of which the hydrotalcite was fixed. The glossiness of this roller surface was measured in the manner described previously, to obtain the results shown in Table 1.

Incidentally, in FIG. 1, reference numeral 1 denotes the conductive substrate; 2, the conductive elastic layer; 3, the conductive cover layer; 3*a*, the inner layer; 3*b*, the outer layer (surface layer); and 3*c*, a powder layer (a layer formed by coating the powder).

Example 2

By the same procedure as the procedure in Example 1, and using as the coating powder the hydrotalcite subjected to surface hydrophobic treatment with stearic acid by 3%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 60 seconds. Thus, a roller was obtained to the whole roller surface of which the hydrotalcite was fixed. The glossiness of this roller surface was measured in the manner described previously, to obtain the results shown in Table 1.

Example 3

By the same procedure as the procedure in Example 1, but using as the coating powder a zinc oxide subjected to surface hydrophobic treatment with an organopolysiloxane by 10%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 16 seconds. Thus, a roller was obtained to the whole roller surface of which the zinc oxide was fixed. The glossiness of this roller surface was measured in the manner described previously, to obtain the results shown in Table 1.

Example 4

By the same procedure as the procedure in Example 1, but using as the coating powder a zinc oxide subjected to surface hydrophobic treatment with an organopolysiloxane by 10%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 60 seconds. Thus, a roller was obtained to the whole roller surface of which the zinc oxide was fixed. The glossiness of this roller surface was measured in the manner described previously, to obtain the results shown in Table 1.

Example 5

By the same procedure as the procedure in Example 1, but using as the coating powder a titanium oxide subjected to surface hydrophobic treatment with a silane coupling agent by 10%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 16 seconds. Thus, a roller was obtained to the whole roller surface of which the titanium oxide was fixed. The glossiness of this roller surface was measured in the manner described previously, to obtain the results shown in Table 1.

Comparative Example 1

By the same procedure as the procedure in Example 1, but using as the coating powder a hydrotalcite not subjected to surface treatment, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 16 seconds. Thus, a roller was obtained to the whole roller surface of which the hydrotalcite was fixed. The glossiness of this roller surface was measured in the manner described previously, to obtain the results shown in Table 1.

Comparative Example 2

By the same procedure as the procedure in Example 1, but using as the coating powder a zinc oxide not subjected to surface treatment, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 16 seconds. Thus, a roller was obtained to the whole roller surface of which the zinc oxide was fixed. The glossiness of this roller surface was measured in the manner described previously, to obtain the results shown in Table 1.

Comparative Example 3

By the same procedure as the procedure in Example 1, but using as the coating powder a titanium oxide not subjected to surface treatment, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 16 seconds. Thus, a roller was obtained to the whole roller surface of which the titanium oxide was fixed. The glossiness of this roller surface was measured in the manner described previously, to obtain the results shown in Table 1.

Comparative Example 4

By the same procedure as the procedure in Example 1, and using as the coating powder the hydrotalcite subjected to surface hydrophobic treatment with stearic acid by 3%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 8 seconds. Thus, a roller was obtained to the whole roller surface of which the hydrotalcite was fixed. The glossiness of this roller surface was measured in the manner described previously, to obtain the results shown in Table 1.

Comparative Example 5

By the same procedure as the procedure in Example 1, but using as the coating powder a zinc oxide subjected to surface hydrophobic treatment with an organopolysiloxane by 10%, the conductive roller was coated therewith. Then the powder rub-over member was so pressed against the roller surface that a load of 0.06 kg/cm$^2$ was applied thereto, and was reciprocatingly moved in the roller lengthwise direction at a rate of 600 mm/sec for 90 seconds. Thus, a roller was obtained to the whole roller surface of which the zinc oxide was fixed. The glossiness of this roller surface was measured in the manner described previously, to obtain the results shown in Table 1.

Comparative Example 6

For comparison, the roller was not coated with the powder. The glossiness of the resultant roller surface was measured in the manner described previously, to obtain the results shown in Table 1.

Figure 2:
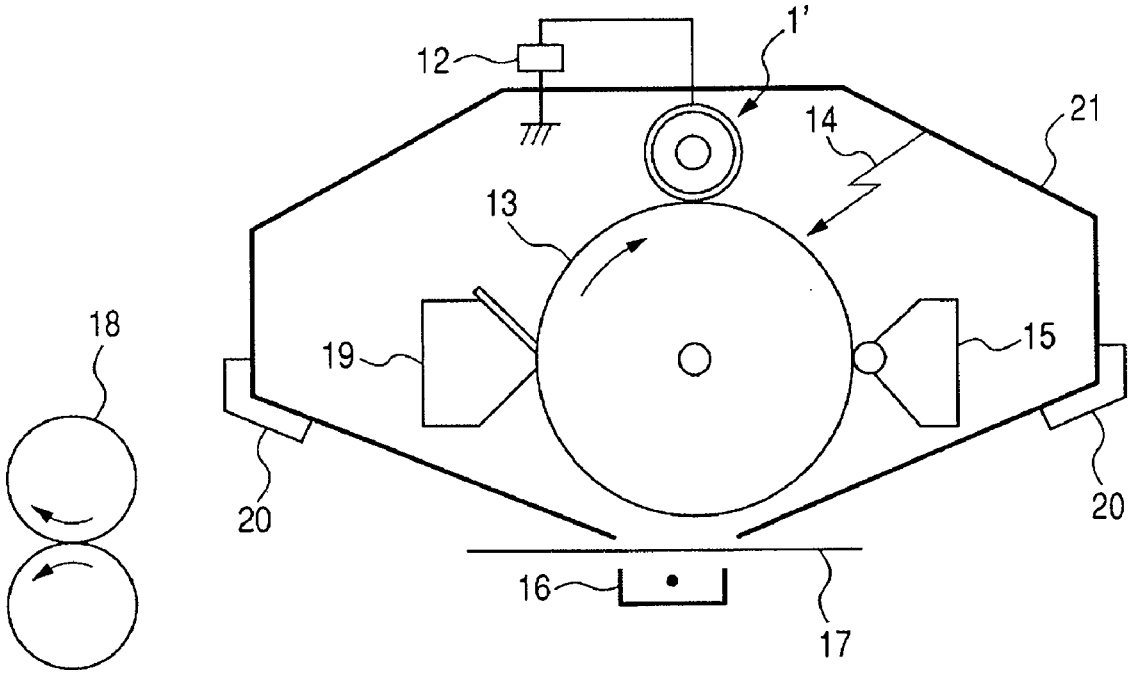
FIG. 2 illustrates an electrophotographic apparatus having a process cartridge.

Evaluation:

To evaluate images, using an LBP (laser beam printer) main body (HP Laser Jet 1320), the conductive roller obtained was set as a charging roller in the process cartridge (Q5949) shown in FIG. 2, and images were reproduced on 6,000 sheets in an intermittent mode. Whether or not any faulty images due to the adhesion of photosensitive-member abrasion dust occurred was examined. Also, the conductive roller was pulled out after the running, and the level of the adhesion of toner and external additives to the roller surface was visually ascertained. Incidentally, in FIG. 2, reference numeral 1' denotes the charging roller; 12, a power source for the charging roller 1'; 13, a photosensitive member (electrophotographic photosensitive member) to be electrostatically charged by the charging roller 1'; 14, imagewise exposure by which an electrostatic latent image is formed on the photosensitive member 13 having been charged; 15, a developing assembly which develops the electrostatic latent image to form a visible image (toner image); 16, a transfer assembly which transfers the visible image to a transfer material 17; 17, the transfer material (such as paper); 18, a fixing assembly which fixes the visible image held on the transfer material 17; 19, a cleaning assembly which removes the toner remaining on the photosensitive member 13 after transfer; 20, main-body rails for mounting the process cartridge; and 21, the process cartridge, in which the charging roller 1', the photosensitive member 13, the developing assembly 15 and the cleaning assembly 19 are integrally supported and which is detachably mountable to the main body of an electrophotographic apparatus.

The results of evaluation are shown together in Table 1. In Table 1, the adhesion as "A" shows that the toner and external additives can not easily adhere, and "C" shows that the toner and external additives tend to adhere. The faulty image due to adhesion as "AA" shows that no faulty image appears. "A" shows that faulty images come not to appear after image reproduction on about several tens of sheets, and fall under the region of practical use. "C" shows that faulty images do not come not to appear even after image reproduction on about several tens of sheets.

From the foregoing, it has been verified that the toner and external additives have been made less adhere and the faulty images due to the adhesion of photosensitive-member abrasion dust have been made not easily appear by rubbing over, and fixing to, the conductive-roller surface the inorganic compound the particle surfaces of which have been subjected to hydrophobic treatment.

This application claims priority from Japanese Patent Application No. 2005-020112 filed on Jan. 27, 2005, which is hereby incorporated by reference herein.

TABLE 1

| | Example | | | | |
|---|---|---|---|---|---|
| | 1 | 2 | 3 | 4 | 5 |
| Inorganic compound: | Hydrotalcite | Hydrotalcite | Zinc oxide | Zinc oxide | Titanium oxide |
| Inorganic compound surface hydrophobic = treating agent: | Stearic acid | Stearic acid | Organopoly-siloxane | Organopoly-siloxane | Silane coupling agent |
| Roller surface glossiness: | 7.7% | 18.1% | 15.3% | 19.7% | 13.6% |
| Toner adhesion: | A | A | A | A | A |
| Faulty images due to adhesion: | AA | AA | A (disappeared after printing on 13 sheets) | A (disappeared after printing on 13 sheets) | A (disappeared after printing on 15 sheets) |

| | Comparative Example | | | | | |
|---|---|---|---|---|---|---|
| | 1 | 2 | 3 | 4 | 5 | 6 |
| Inorganic compound: | Hydrotalcite | Zinc oxide | Titanium oxide | Hydrotalcite | Zinc oxide | No coating |
| Inorganic compound surface hydrophobic = treating agent: | None | None | None | Stearic acid | Organopoly-siloxane | None |
| Roller surface glossiness: | 8.4% | 14.7% | 12.2% | 7.2% | 23.5% | 17.9% |
| Toner adhesion: | C | C | C | C | C | C |
| Faulty images due to adhesion: | C (black lines) | C (black lines) | C (black lines) | C (black lines) | C (black lines) | C (black lines) |

What is claimed is:

1. A conductive roller which comprises a conductive substrate, a conductive elastic layer and a conductive cover layer, wherein;

said conductive cover layer is formed of a seamless tube containing a thermoplastic polymer, the surface of said conductive roller is coated with an inorganic compound the particle surfaces of which have been subjected to hydrophobic treatment, and the roller having been coated therewith has a glossiness of from 7.5% or more to less than 22.0%.

2. The conductive roller according to claim 1, wherein the particle surface hydrophobic treatment of said inorganic compound has been carried out using a fatty acid, a coupling agent, an ester or an oil.

3. The conductive roller according to claim 1, wherein the particle surface hydrophobic treatment of said inorganic compound has been carried out using any of stearic acid, oleic acid and palmitic acid, or using a metal salt of stearic acid, oleic acid or palmitic acid.

4. A process cartridge which integrally supports an electrophotographic photosensitive member and a charging member, or an electrophotographic photosensitive member, a charging member and either or both of a developing means and a cleaning means, and is detachably mountable to the main body of an electrophotographic apparatus, wherein;

said charging member is a charging member provided in contact with said electrophotographic photosensitive member and capable of charging said electrophotographic photosensitive member upon application of a voltage, and makes use of the conductive roller according to claim 1.

5. An electrophotographic apparatus which comprises an electrophotographic photosensitive member, a charging member, an exposure means, a developing means and a transfer means, wherein;

said charging member is a charging member provided in contact with said electrophotographic photosensitive member and capable of charging said electrophotographic photosensitive member upon application of a voltage, and makes use of the conductive roller according to claim 1.

* * * * *